US006343562B1

(12) United States Patent
Ingram

(10) Patent No.: US 6,343,562 B1
(45) Date of Patent: Feb. 5, 2002

(54) CANOE AND KAYAK MID-POINT SPONSONS SAFETY

(75) Inventor: Robert Timothy Ingram, Penetanguishene (CA)

(73) Assignee: Robert T. Ingram, Penetanguishene (CA)

( * ) Notice: Subject to any disclaimer, the term of this patent is extended or adjusted under 35 U.S.C. 154(b) by 0 days.

(21) Appl. No.: 09/628,194

(22) Filed: Jul. 24, 2000

(51) Int. Cl.[7] ..... B63B 35/71

(52) U.S. Cl. ..... 114/347; 114/68; 114/69; 114/123; 114/360

(58) Field of Search ..... 114/121, 123, 114/283, 343, 345, 347, 360, 219, 354, 68, 69; 441/40, 41, 66

(56) References Cited

U.S. PATENT DOCUMENTS

| | | | | | |
|---|---|---|---|---|---|
| 655,234 | A | * | 8/1900 | Howe et al. | 114/123 |
| 1,038,928 | A | * | 9/1912 | Menzel | 114/123 |
| 1,577,614 | A | * | 3/1926 | Edwards | 114/123 |
| 2,600,757 | A | * | 6/1952 | Grimston | 114/123 |
| 3,100,100 | A | * | 8/1963 | Carpenter | 114/123 |
| 3,121,888 | A | * | 2/1964 | Morgan et al. | 114/360 |
| 3,339,218 | A | * | 9/1967 | Stamberger | 114/123 |
| 3,537,417 | A | * | 11/1970 | Beckner | 114/123 |
| 4,616,591 | A | * | 10/1986 | Minor | 114/347 |
| 4,817,555 | A | * | 4/1989 | Meinen | 114/360 |
| 4,838,196 | A | * | 6/1989 | Ingram | 114/347 |
| 4,864,961 | A | * | 9/1989 | Slonski | 114/360 |
| 4,996,936 | A | * | 3/1991 | Brundritt | 114/68 |
| 5,279,248 | A | * | 1/1994 | Blachford | 114/347 |
| 5,357,888 | A | * | 10/1994 | Insinna | 114/69 |
| 5,411,425 | A | * | 5/1995 | Rinker | 441/130 |
| 5,515,802 | A | * | 5/1996 | Bree | 114/123 |
| 5,542,369 | A | * | 8/1996 | Ingram | 114/347 |

* cited by examiner

*Primary Examiner*—S. Joseph Morano
*Assistant Examiner*—Lars A. Olson

(57) ABSTRACT

Canoe and kayak mid-point sponsons attach to the canoe or kayak only at the mid-point of the sponsons, to enable the sponsons to rotate around the midpoint in order to reduce drag in waves and simplify attachment and detachment to the canoe or kayak, while also permitting much greater sponson buoyancy volume than any other type of sponson, without interfering with normal paddling to safety. They are attached to any canoe or kayak by material such as only one adjustable strap and two clips, extending to kayak deck fittings adjacent the cockpit or a canoe middle thwart, in such a manner as to facilitate normal paddling of the stabilized craft in life threatening emergencies. They can be directly attached to both sides of the hull near the waterline. The mid-point sponsons can be solid buoyant material, waterproof and airtight stowage bags containing bulky light-weight items such as sleeping bags, orally inflatable sponson floats, and gas cartridge inflatable sponson floats. A particular feature is permanent or semi-permanent attachment to the hull above the waterline to eliminate drag unless inflated, in which case the inflated sponsons are forced to immerse in the water. When not inflated each midpoint sponson would be neatly stowed in a small and rescue-emergency marked stowage bag or covering that holds sponsons upward from the waterline. Such an arrangement ensures that the sponsons rest sleekly and unobtrusively along the hull side when not deployed.

5 Claims, 1 Drawing Sheet

CANOE AND KAYAK MID-POINT SPONSONS SAFETY

BACKGROUND OF THE INVENTION

1. Field of the Invention

The invention relates to canoe and kayak safety derived from mid-point sponsons that permit greater buoyancy volume than normal sponsons, for higher stability from both a larger righting arm as well as more buoyancy force. This buoyancy force is most important when people with poor strength or fitness, sudden illness or in capsizing conditions require a sling to help them re-enter from the water. Mid-point sponsons, attached by only one point, can be pushed away from the hull upon re-entry, further immersing the sponson for greater buoyancy as well as creating a longer righting arm away from the hull side. The mid-point sponsons attach to the canoe or kayak only at the mid-point of the sponsons, to enable the sponsons to rotate around the midpoint in order to reduce drag in waves and simplify attachment and detachment to the canoe or kayak.

A particular feature is permanent or semi-permanent attachment to the hull above the waterline to eliminate drag unless inflated, in which case the inflated sponsons are forced to immerse in the water as shown in FIG. 2 of drawings, creating a massive stability arm instantly by gas cartridge, or in two minutes using a two foot long oral inflation tube, whether inflated from the water or the cockpit. When not inflated each midpoint sponson would be neatly stowed in a small and rescue-emergency marked stowage bag or covering that would hold sponsons upward from the waterline. Such an arrangement ensures that the sponsons rest sleekly and unobtrusively along the hull side when not deployed, each protected by an emergency stowage bag or covering and the midpoint sponson attachment point to the strap, shown in FIG. 2 as slightly below the waterline 13, would be instead somewhat above the waterline to eliminate drag almost entirely. Likewise an attachment point directly to the hull would be above the design waterline to eliminate all drag.

2. Prior Art

Canoes and Kayaks are dangerous in capsizing conditions such as winds and waves. Winds can occur suddenly without clear warning. Canoes and kayaks cannot be paddled fast enough to escape these natural threats. Capsized kayaks and canoes are flooded and cannot be reliably rescued except by larger craft such as Coast Guard Rigid Inflatable boats, with large air-filled sponsons on a rigid hull. These are the most stable small powercraft in the world, and Coast Guards use them around the world.

Kayaks cannot be rescued reliably by Eskimo rolling because experts are left in the same capsizing conditions as before capsize, if they successfully roll up (after their bracing skills have just been inadequate to prevent capsize in the first place.) Most experts admit they do not roll with 100 per cent reliability since they normally do not practise rolls in all capsizing conditions, or they are paddling kayaks loaded differently from practice, perhaps using different paddles or suffering from seasickness or other ailments that are only a few of dozens of different circumstances that make rolls unreliable, such as capsizing conditions. Few experts are fortunate to roll repeatedly in capsizing conditions when water intrudes under sprayskirts with each roll, making kayaks increasingly less stable, and rolls less reliable. Kayak rolling is not at all possible for most of the public, let alone with any degree of reliability as required for safety. Canoe rolling is not normally possible except in specially equipped open canoes with massive internal flotation and young and fit experts highly practised in this refined technical skill. Only normal sponsons now provide reliable rescues due to normal sponsons providing high secondary stability coupled with the inevitable flooded kayak cockpit upon capsize. The weight of water is stabilized by sponsons, not sloshing transversely to destabilize kayaks and canoes, and creates ballast stability coupled with the righting arm of sponson buoyancy in capsizing conditions. Sponsoned kayaks and canoes are much more stable than before capsize. Rolling is practised by some groups with great enthusiasm and enjoyment, no matter how unreliable in capsizing conditions. There is a cult belief in the safety of rolls and ritualized practice, no matter how unreliable.

Some groups recognize that rolls need back-up safety and use a paddlefloat, while recognizing that paddlefloat rescues are less reliable than the rolls they backup. The paddlefloat rescue uses a float on the end of a paddle as a lever to assist on re-entry of kayaks. This does not stabilize the kayak upon reentry and is condemned as a "calm water rescue" by the British Canoe Union and others world wide. The one-side lever recapsizes paddlers by rising on waves or submerging and tripping the kayak in waves, and it regularly breaks the most expensive lightweight paddles when used as a lever for a load weight that paddles are not designed to carry. The kayaker is not stabilized adequately while pumping out cockpit water, a long and tiring task using a pump that requires 2 hands through an opening in the spray skirt that attempts to prevent more water from flooding in. But even small one foot waves wash over any flooded, or loaded kayak and refill it. Calm water avoids this problem. Sprayskirts are awkward and permit gradual intrusion of water in normal situations apart from emergencies. Finally the paddle must be retrieved from behind the seated paddler and the paddlefloat removed in capsizing conditions. This is a precarious procedure and usually results in recapsize since the capsized victim is less stable than before capsize when a paddle was available for bracing strokes, to stabilize the kayak.

Open canoes cannot be paddled to safety while flooded due to insufficient buoyancy and stability, although optimistic and misleading instruction states the contrary. Flooded canoes without sponsons simply roll over when re-entry attempts are made. Dozens of well documented coroner inquests into canoeing deaths confirm this reality. Expert canoeists without sponsons die of hypothermia in wilderness areas after capsize, when winds build in strength without clear warning, or river waves flood canoes. Sponsoned canoes survive descents of large rivers without capsize due to high secondary stability in rapids.

Assisted rescues for canoes and kayaks are highly circumstantial and risk the lives of would-be rescuers in emergency conditions. Some experts agree to "suicide pacts", not attempting to rescue one-another in emergencies lest the rescuers capsize too. Loaded canoes cannot be lifted and emptied over the gunwale of a rescuing canoe in capsizing conditions, any more than many hundreds of pounds of loaded kayak can be lifted out of the water. Even unloading heavy packs from open canoes will risk the group due to exposure from lost clothes, food, tents. (Such heavy packs are usually waterproofed and will provide interior flotation if secured within, since they do float and prevent the same volume of heavier water from occupying the space and sinking the craft lower in the water. Heavy packs cannot be retrieved in capsizing conditions without capsizing open canoes and all of these futile emergency operations leave victims in the cold water too long to avoid hypothermia. They cannot work hands after only a few minutes, although it may be hours before the body core temperature is low enough to kill. Even if these operations were remotely possible, canoes and kayaks simply reflood in the same waves and wind that have not mysteriously disappeared, in reality.) Sponsoned canoes and kayaks do not depend on removal of water inside but use it as ballast stability. All kayaks and canoes must have sufficient internal flotation in the ends or they are death traps.

All of the above information has been well-documented in major canoe and kayak publications, although not in a logically consistent fashion. Authors and instructor groups contradict each others' emphases on particular safety techniques, increasing the safety risks for the public. The quick and reliable transformation of all canoes and kayaks into life rafts, that can reliably rescue victims from cold water (and even be paddled or towed, so stabilized, to a safe shore), is the most strategic and comprehensive safety possible. In comparison all other rescues are highly circumstantial, dependent on magical thinking that conditions leading to emergency capsizes have suddenly disappeared or that highly practised technical skills will be reliable, and even repeatedly reliable (although apparently not reliable enough to avoid capsize in the first place.) Sponsons replace irrational safety opinions with scientifically proven strategic stability that can be replicated anywhere, anytime, according to scientific method, in minutes or even seconds. Mid-point sponsons create a much more powerful stability equation than normal sponsons, to dramatically change the irrational safety climate that instructors and manufacturers have created, both unintentionally and from habit, to make money from repeated lessons. Instruction based on realistic paddling skills, judgment skills, weather reading etc, is extremely worthwhile. Specious and inconsistent instruction is confusing and ultimately kills the public.

It is desirable to create mid-point sponsons because midpoint sponsons can provide greatly increased stability, more than double the stability of normal sponsons, while permitting normal paddling with only a small drag penalty over normal sponsons (U.S. Pat. No. 4,838,196). Mid-point sponsons can provide a dramatic righting arm to permit a disabled paddler to step into a sling, using large leg muscles to get back into a kayak or canoe. Normal sponsons cannot provide as great a lever arm while still permitting normal paddling or sailing.

Mid-point sponsons dramatically, by simple observation, refute the unscientific opinions of some poorly educated "naval architects" who do not understand secondary stability; since the midpoint sponsons are not fully immersed except upon re-entry, and otherwise float almost entirely out of the water unless the kayak or canoe is leaned, whereupon the massive righting arm acts impressively, like the massive air sponsons on Coast Guard Rigid Inflatable Rescue Boats.

The unfortunate habits of safety instruction die hard, even among the most well-intentioned instructor organizations. The most powerful demonstration of mid-point sponsons is required, to change safety instruction. This most powerful demonstration would appear to be permanent or semi-permanent attachment to the hull above the waterline to eliminate drag unless inflated, in which case the inflated sponsons are forced to immerse in the water as shown in FIG. 2 of drawings, creating a massive stability arm instantly by gas cartridge, or in two minutes using a two foot long oral inflation tube, whether inflated from the water or the cockpit. When not inflated each midpoint sponson would be neatly stowed in a small and rescue-emergency marked stowage bag or covering that would hold sponsons upward from the waterline. Such an arrangement ensures that the sponsons rest sleekly and unobtrusively along the hull side when not deployed, each protected by an emergency stowage bag or covering, and the midpoint sponson attachment point to the strap 13, shown in FIG. 2 as slightly below the waterline, would be somewhat above the waterline to eliminate drag almost entirely. Likewise an attachment point directly to the hull would be above the design waterline to eliminate all drag. Clearly the instant inflation by gas cartridge of such powerful stability and seaworthiness, could not be easily dismissed.

SUMMARY OF THE INVENTION

The present invention reduces some of the problems of the prior art by providing much greater stability than normal sponsons (at least double) while still permitting normal paddling to safety with only slightly more drag than normal sponsons. Canoe and kayak mid-point sponsons attach to the canoe or kayak only at the mid-point of the sponsons, to enable the sponsons to rotate around the midpoint in order to reduce drag in waves and simplify attachment and detachment to the canoe or kayak, while also permitting a much greater sponson buoyancy volume without interfering with normal paddling to safety. This buoyancy force is most important when people with poor strength, health, or fitness require a sling to help them reenter from the water. Mid-point sponsons, attached by only one point, can be pushed away from the hull upon re-entry, further immersing the sponson for greater buoyancy as well as creating a longer righting arm away from the hull side. Sponsons normally extend from the lines of the hull along the waterline on both sides and do not float independently of the incline of the hull when paddled into waves, as is the case of mid-point sponsons. Sponsons are normally not as short as mid-point sponsons, but are longer and much thinner to facilitate paddling. Mid-point sponsons are much thicker but are also shorter to facilitate normal paddling. Mid-point sponsons permit a much greater buoyancy volume while also permitting normal paddling. The sponsons are connected below the waterline by material such as a strap that can be adjusted in length to fit canoes and kayaks of differing widths. The sponsons are connected to the canoe or kayak above the waterline by material such as a strap and two secure clips or snap hooks extending to kayak deck fittings adjacent the cockpit or a canoe middle thwart, in such a manner as to facilitate normal paddling of the stabilized craft in life threatening emergencies. Alternatively the mid-point sponsons can be directly attached to both sides of the hull near the waterline. The sponsons can be any buoyancy system including solid buoyant material, waterproof and airtight stowage bags containing bulky lightweight items such as sleeping bags, orally inflatable sponson floats, and gas cartridge inflatable sponson floats.

The mid-point sponsons, according to the invention consist two buoyant sponson floats, shorter and thicker than normal sponsons (U.S. Pat. No. 4,838,196). The sponsons are thick enough that they can be inflated by a paddler sitting in the cockpit of a kayak while leaning forward, without needing a long inflation tube to orally inflate from the cockpit. The sponsons are thick enough to inflate from the water after capsize without the victim's head coming too close to the hard boat hull while orally inflating the sponsons. Alternatively the midpoint sponsons can be secured on the rear deck of a kayak, already inflated, or within an open canoe. The mid-point sponsons might consist of two sealed, waterproof and watertight stowage bags that contain only large, lightweight bulky items like a sleeping bag and stowed on deck or within as above, ready to deploy. Deployment of such sealed, already inflated floats, or floats made from buoyant material is normally accomplished from the water after capsize by attaching the nearest sponson to the deck hardware of a righted but flooded kayak by means of a secure clip or snap hook, etc. On open canoes the nearest sponson is normally attached to the middle thwart. The remaining float is pushed under the canoe or kayak to the other side and clipped. This is easily accomplished by pushing with an arm or leg, the buoyant force insufficient to impede this operation, although this same buoyant force is multiplied when in place as a righting lever arm. The remaining clip is attached to the deck hardware or middle thwart on the other side. Alternatively floats can attach directly to fastening points on the hull, near the waterline. In this case it may be easier to clip the floats directly to the hull of an overturned kayak or canoe, then gripping one float, lean back to use body weight to submerge other float and flip canoe or kayak upright. This is easier than flipping a righted sponsoned canoe or kayak over (i.e. capsize) because water ballast and paddler body weight are coupled with sponson righting arm for much greater secondary stability and body core out of cold water to avoid hypothermia.

The mid-point sponsons have great enough righting arm to be used with a simple stirrup or sling to assist disabled victims back into the boat. The mid-point sponsons may be clipped to deck hardware adjacent the kayak cockpit aft of the cockpit because the deck is lower and flatter aft to make re-entry easier. Mid-point sponsons are always clipped between the cockpits on a double kayak because this is the widest point of beam, (as is the middle thwart of any open canoe), to create the greatest stability arm from any given sponson float. Alternatively, mid-point sponsons may be preferred forward of the kayak cockpit as they may interfere less with paddling strokes, particularly steering strokes. Also they are visible to the paddler there and may be reached easily by leaning forward, to deflate slightly to decrease drag, or to unclip and deflate entirely, to stow when an emergency is passed. (Or when sailing, swimming, sunbathing, napping, snorkelling or swimming is passed. You may want a much more stable canoe or kayak for recreational uses, as well as safety.) The forward sponsons can be deployed from the cockpit by leaning forward to orally inflate, then sliding them forward and clipping to the deck hardware forward of the cockpit.

Finally the mid-point sponsons can be clipped to the canoe or kayak and then inflated immediately by means of a gas cartridge. This would be similar to Coast Guard approved inflatable lifejackets for people, but stabilizing instead kayaks and canoes in a most impressive, fast, and failsafe manner. And at much less cost than drysuits that are causing extreme discomfort to paddlers to the point of heatstroke. Overheated paddlers have died by not wearing dry suits properly zipped up, that become flooded with water inside and make it impossible to swim or get out of the water without outside help. Mid-point sponsons can guarantee that they can get out of cold water and live without risk of heatstroke, at a cost as little as $20 U.S. in large economies of scale, sponsons for every kayak and canoe. This compares to more than $400 U.S. per drysuit, retail.

A particular feature is permanent or semi-permanent attachment to the hull above the waterline to eliminate drag unless inflated, in which case the inflated sponsons are forced to immerse in the water as shown in FIG. 2 of drawings, creating a massive stability arm instantly by gas cartridge, or in two minutes using a two foot long oral inflation tube, whether inflated from the water or the cockpit. When not inflated each midpoint sponson would be neatly stowed in a small and rescue-emergency marked stowage bag or covering that would hold sponsons upward from the waterline. Such an arrangement ensures that the sponsons rest sleekly and unobtrusively along the hull side when not deployed, each protected by an emergency stowage bag or covering, and the midpoint sponson attachment point to the strap 13, shown in FIG. 2 as slightly below the waterline, would be somewhat above the waterline instead, to eliminate drag almost entirely. Likewise an attachment point directly to the hull would be above the design waterline to eliminate all drag. It should be noted that material such as a single strap running under the hull of a kayak or canoe near the mid-point cannot cause any significant drag at all, due to the fact that water is in turbulent flow at this point of the hull anyway, unlike the area of laminar flow.

The invention, as exemplified by a preferred embodiment, is described with reference to the drawings.

DETAILED DISCLOSURE

Figure 1:
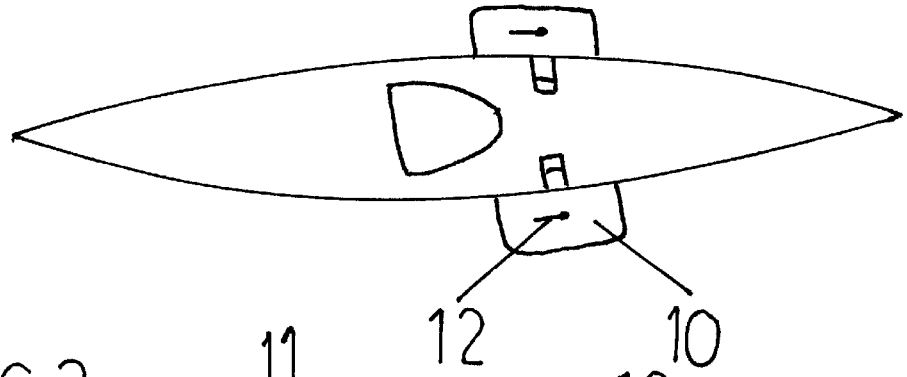
FIG. 1 is a simplified top view of the mid-point sponsons attached to a single cockpit kayak, forward of the cockpit. The mid-point sponsons are inflated by means of the short inflation tube shown in the centre of each sponson.
Figure 2:
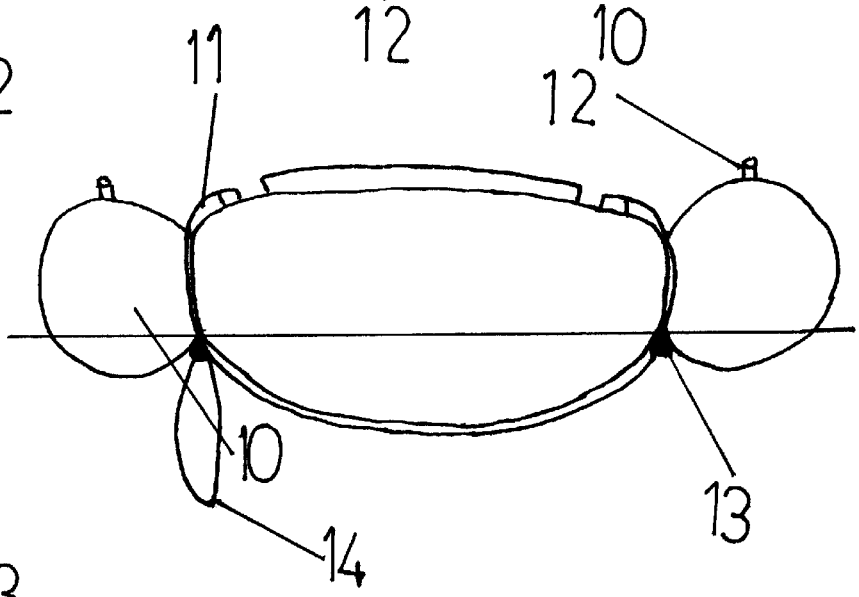
FIG. 2 is a simplified transverse section showing the inflated sponsons attached to a kayak by means of a single length of material such as a strap with a clip.
Figure 3:
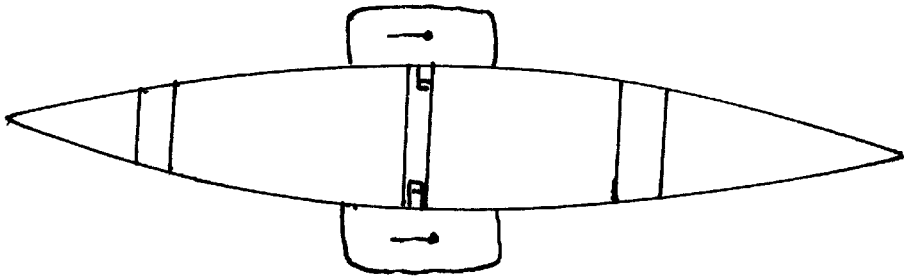
FIG. 3 is a simplified top view of the mid-point sponsons attached to an open canoe.

Referring to FIGS. 1 through 3 mid-point sponsons 10 according to the invention are attached to a kayak adjacent the cockpit by a single length of material such as a strap 11. The mid-point sponsons 10 are attached adjacent to the cockpit or to the middle canoe thwart, but permit normal paddling. The mid-point sponsons are inflated by means of a short inflation tube 12. The strap 11 is attached to the mid-point of each sponson by a simple clip or knot 13. The mid-point sponsons are held down in the water by the clip or knot 13 allowing most of the sponsons to float above the waterline, to ensure secondary buoyancy when the kayak or canoe is heeled but minimize the amount of sponson immersed to reduce drag when paddled or towed. The mid-point sponsons rotate around the strap attachment point 13 at the mid-point of each sponson, to reduce drag when paddling into waves as the front of each sponson can rise independently of the hull, reducing the amount of drag that would be created by immersed volume if they were not allowed to follow the slope of a wave, and dug into the face of each wave instead.

The sling 14 is a simple strap or stirrup for disabled paddlers to step into, to use large leg muscles to hoist body weight out of the water and into the kayak or canoe. The paddler also pushes the sponson to which the sling 14 is attached down in the water and outward from the hull for the maximum righting arm that can be produced from the float upon re-entry. Each midpoint sponson 10 can do this because it is attached to the hull only at the single mid-point 13. Otherwise the force of buoyancy maintains minimal sponson immersion for reduced drag. If a sling is needed then the mid-point sponsons 10 would likely be attached aft of the kayak cockpit where the deck is lower and flatter for re-entry.

Attachment forward of the kayak cockpit may be preferred because the midpoint sponsons 10 are visible and easily reached by leaning forward, to deflate the sponsons slightly by means of the inflation tube 12 to reduce drag. Or the sponsons can be deflated entirely, detached and stowed securely if not needed for safety or recreational pursuits for which stability is desirable. The mid-point sponsons can be deployed from the cockpit, leaning forward to orally inflate using the inflation tube 12. And then sliding them forward to attach to the deck hardware. Normally after capsize mid-point sponsons 10 are deployed on an upright flooded kayak or canoe from the water, attaching a mid-point sponson to the nearest deck hardware or canoe thwart first, then inflating the remaining far-side mid-point sponson and pushing it under the hull. (Full or partial inflation assists this task, popping up on the far side to clip to the far side deck hardware by reaching over the low flooded kayak.) Then inflate the remaining near-side sponson and re-enter.

A particular feature is permanent or semi-permanent attachment to the hull above the waterline to eliminate drag unless inflated, in which case the inflated sponsons are forced to immerse in the water as shown in FIG. 2 of drawings, creating a massive stability arm instantly by gas cartridge, or in two minutes using a two foot long oral inflation tube, whether inflated from the water or the cockpit. There may be immersion efficiency advantages to a square or rectangular cross-section over round as shown. Also a sliding attachment point 13, able to be locked in either immersion or no drag positions on a single strap, cord, or wire could be advantageous as well.

When not inflated each midpoint sponson would be neatly stowed in a small and rescue-emergency marked stowage bag or covering that would hold sponsons upward from the waterline. Such an arrangement ensures that the sponsons rest sleekly and unobtrusively along the hull side when not deployed, each protected by an emergency stowage bag or covering and the midpoint sponson attachment point to the strap 13, shown in FIG. 2 as slightly below the waterline, would be somewhat above the waterline to eliminate drag almost entirely. Likewise an attachment point directly to the hull would be above the design waterline to eliminate all drag.

These procedures are similar with open canoes whether deployed from the water or from the interior of the canoe.

OPERATION

Referring to FIGS. 1 through 3 it can be seen that mid-point sponsons 10 permit normal paddling while deployed either fore or aft of the kayak cockpit. (Or between the cockpits of double kayaks, at the point of maximum beam for highest secondary stability.) Mid-point sponsons 10 attach to the middle thwart of open canoes, the point of maximum beam. Only a single length of material such as a strap 11 attaches mid-point sponsons 10 to a canoe or kayak for ease of attachment and detachment. The strap 11 attaches to the mid-point of each sponson 13 to allow: a) each sponson to rotate around point 13 independent of the hull, to minimize immersed drag paddling into waves, b) each sponson to be pushed down into the water and away from the side of the hull for maximum righting lever upon re-entry, c) each sponson to normally float above the waterline with minimal immersed volume and drag while paddling, while ensuring optimal and massive secondary stability when leaned. Mid-point sponsons 10 create highly visible as well as high-powered secondary stability, to refute dangerous myths, perpetrated by ignorance, that wide kayaks and canoes with massive secondary stability are less stable in large breaking waves than narrow canoes and kayaks.

It can be seen that mid-point sponsons 10 can be deployed on canoes and kayaks from the interiors or cockpits respectively, or from the water after capsize. They can be fully inflated and secured on the rear decks of kayaks or inside canoes, before deployment in emergencies. Mid-point sponsons can stow bulky lightweight items like sleeping bags in airtight and waterproof security, or they can be made from buoyant material. They can inflate immediately after attachment using gas cartridges, like Coast Guard inflatable lifejackets.

A particular feature is permanent or semi-permanent attachment to the hull above the waterline to eliminate drag unless inflated, in which case the inflated sponsons are forced to immerse in the water as shown in FIG. 2 of drawings, creating a massive stability arm instantly by gas cartridge, or in two minutes using an oral inflation tube, whether inflated from the water or the cockpit. When not inflated each mid-point sponson would be neatly stowed in a small and rescue-emergency marked stowage bag or covering that would hold sponsors upward from the waterline. Such an arrangement ensures that the sponsons rest sleekly and unobtrusively along the hull side when not deployed, each protected by an emergency stowage bag or covering, and the midpoint sponson attachment point to the strap 13, shown in FIG. 2 as slightly below the waterline, would be somewhat above the waterline to eliminate drag almost entirely. Likewise an attchament point directly to the hull would be above the design waterline to eliminate all drag.

Alternatively mid-point sponsons can be attached in seconds by clipping on the far sponson first, then swimming the kayak or canoe sideways to bring the remaining sponson into reach, then clipping the near sponson and inflating both.

It can be seen that mid-point sponsons 10 are the only means to create: 1) the highest secondary stability possible, 2) the most reliable stability possible, and 3) the quickest stability possible, for safety; while still permitting paddling (or towing) to safety, the other essential component to the highest possible safety standard for kayaks and canoes. This ultimate safety standard transforms every kayak and canoe into an optimally stable life raft that can be paddled to safety. Attachment of sponsons is a matter of seconds using secure clips or snaps, or no attachment time at all using the semi-permanent or permanent attachment feature, with emergency stowage bags or coverings described above. Inflation time can be nearly or totally eliminated by gas cartridges, stowage sponsons or solid buoyancy sponsons.

Handling of the kayak is not adversely affected, paddling in waves or calm water. Mid-point sponsons one foot in diameter and two feet long do not interfere with paddling when mounted forward or aft of the cockpit. The massive transverse stability is very apparent and appears to assist disabled paddlers with re-entry so significantly that some no longer require a sling 14. An overturned kayak with sponsons deployed merely requires the paddler to kneel with full body weight on the nearest sponson while gripping the far mid-point 13 for balance, to cause the submerged sponson to pop up on the other side, self-righting the kayak. This certainly is ultimate canoe and kayak safety by any standard, and far safer than any tricks of skill: rolling kayaks or balancing paddlefloats in emergencies.

I claim

1. An adjustable stability system adapted for attachment to any canoe or kayak, permitting the highest possible stability without preventing normal paddling to safety, comprising:

a pair of buoyancy tubes, the mid-point of each buoyancy tube adapted for attachment to each side of a hull of a canoe or kayak near the waterline and near the point of maximum beam on the hull without preventing normal paddling to safety of said canoe or kayak, the mid-point of said buoyancy tubes also adapted to facilitate attchament from the water after capsize, or from a kayak cockpit or canoe interior before capsize;

and a means of attachment of said buoyancy tubes is generally above the waterline of said canoe or kayak to nearly or totally eliminate drag, said buoyancy tubes are immersed in water to create stability only by inflation, and said buoyancy tubes are each stowed against the hull in a protective bag that is marked rescue emergency.

2. The pair of buoyancy tubes as recited in claim 1, which are capable of being inflated by mouth.

3. The pair of buoyancy tubes as recited in claim 1, which are capable of being inflated by gas cartridge.

4. The pair of buoyancy tubes as recited in claim 1, which are made of buoyant material.

5. The pair of buoyancy tubes as recited in claim 1, capable of stowing bulky lightweight items inside said tubes, in watertight and airtight security and stowed on kayak decks or inside canoes, said stowage capability by means of a roll-down waterproof and airtight closure of each tube, or a waterproof and airtight zipper on each tube, both means of closure commonly used by waterproof and airtight stowage bags.

* * * * *